US005785614A

United States Patent [19]

MacKay, Jr.

[11] Patent Number: 5,785,614

[45] Date of Patent: *Jul. 28, 1998

[54] FULL BARREL BALL BAT WITH END CAP

[75] Inventor: Jack W. MacKay, Jr., Mt. Pleasant, Tex.

[73] Assignee: Hillerich & Bradsby Co., Louisville, Ky.

[ * ] Notice: The term of this patent shall not extend beyond the expiration date of Pat. No. 5,421,572.

[21] Appl. No.: 810,669

[22] Filed: Mar. 3, 1997

Related U.S. Application Data

[60] Division of Ser. No. 396,225, Feb. 28, 1995, abandoned, which is a continuation-in-part of Ser. No. 99,348, Jul. 30, 1993, Pat. No. 5,421,572, Ser. No. 105,924, Aug. 13, 1993, Pat. No. 5,393,055, and Ser. No. 358,549, Dec. 14, 1994, Pat. No. 5,494,280, which is a continuation-in-part of Ser. No. 99,348.

[51] Int. Cl.[6] ..... A63B 59/06

[52] U.S. Cl. ..... 473/566

[58] Field of Search ..... 473/566, 567

[56] References Cited

U.S. PATENT DOCUMENTS

| | | | |
|---|---|---|---|
| 3,727,295 | 4/1973 | Gildemeister | 473/567 |
| 5,421,572 | 6/1995 | Mackay, Jr. | 473/566 |
| 5,494,280 | 2/1996 | MacKay, Jr. | 473/566 |

OTHER PUBLICATIONS

Hillerich "End Cup Balances H&B Softball Bat", Oct. 1977, p. 178 *The Sporting Goods Dealer.*

*Primary Examiner*—Mark S. Graham

*Attorney, Agent, or Firm*—Middleton & Reutlinger; James C. Eaves, Jr.

[57] ABSTRACT

A hollow metal ball bat and end cap in which a full length barrel that is substantially straight throughout its hitting zone to its outer end is included. The end cap is installed in the end of the straight barrel to dampen vibrations, provide enhanced impact characteristics to the bat, concentrate the weight load of the bat at the outer end and create a longer acceptable hitting area or zone.

6 Claims, 3 Drawing Sheets

FULL BARREL BALL BAT WITH END CAP

CROSS REFERENCE TO RELATED APPLICATIONS

This is a division of application Ser. No. 08/396,225 filed Feb. 28, 1995, abandoned, which is a continuation-in-part of the following copending U.S. applications: Ser. No. 08/099,348 for FULL BARREL ALUMINUM BASEBALL BAT AND END CAP filed Jul. 30, 1993, now U.S. Pat. No. 5,421,572; Ser. No. 08/105,924 for BALL BAT WITH CONCENTRATED WEIGHT LOAD AND METHOD OF MAKING SAME filed Aug. 13, 1993, now U.S. Pat. No. 5,393,055; and Ser. No. 08/358,549 for CONCAVE END CAP WITH CONE LOAD FOR BATS filed Dec. 14, 1994, now U.S. Pat. No. 5,494,280, which application is a continuation-in-part of Ser. No. 08/099,348.

BACKGROUND OF THE INVENTION

1. Field of the Invention

The present invention generally relates to bats and more particularly a hollow metal ball bat and end cap. The bat has a full length barrel that is substantially straight throughout its hitting zone to its outer end. The end cap is installed in the end of the substantially straight barrel to dampen vibrations, provide enhanced impact characteristics to the bat, concentrate the weight load of the bat at the outer end and support the bat wall so that it will not flatten or deform permanently.

2. Description of the Prior Art

Conventional wood ball bats have been replaced by hollow aluminum bats in many instances. Various leagues up to the professional level of baseball sanction the use of hollow aluminum bats which have certain well known advantages as compared to wood bats. Hollow aluminum bats have been constructed with the dimensional characteristics and weight characteristics similar to wood bats. In order to obtain maximum velocity of a ball when hit by a hollow aluminum bat, the hitting zone of the bat is constructed to provide a trampoline effect which involves an instantaneous and temporary deformation of the barrel of the bat upon impact with the ball and immediate return of the periphery of the hitting zone of the aluminum bat to an original position in order to provide maximum velocity of the ball leaving the bat thereby obtaining maximum flight distance of the ball. Also, aluminum bats are provided with a closure at the outer end thereof usually in the form of an end cap to provide rigidity to the barrel to prevent the barrel from collapsing when impacting a ball. In presently available baseball bats, when the diameter of the hitting zone of the bat exceeds 2⅝ inches, the tubular end of the barrel of the bat is crimped and stepped down in order to enable a standard existing 2⅝ inch end cap to be used with the stepped down or crimped end of the barrel to reinforce the end of the barrel and rigidify the hitting zone to some extent. The additional rigidity provided by the stepped down crimped area rigidifies the over 2⅝ inch bat and produces a hitting zone that does not obtain the optimum maximum velocity since the increased rigidity reduces the trampoline effect of the hitting zone of the bat.

Various efforts have been made to enable variation in the weight characteristics of the bat including the overall weight of the bat such as by varying the thickness of the peripheral wall of the bat or by placing material interiorly of the bat to increase the inertia of the bat as it is swung toward impact with a ball.

The following prior art discloses various developments in this field of endeavor.

| U.S. Pat. No. | |
|---|---|
| 1,499,128 | 3,955,816 |
| 1,611,858 | 3,963,239 |
| 3,116,926 | 4,241,919 |
| 3,727,295 | 4,744,136 |
| 3,779,551 | 4,763,899 |
| 3,811,596 | 4,844,460 |
| 3,861,682 | 5,114,144 |
| Canadian Patent | |
| 962291 | |

The above listed patents disclose various aluminum bat structures that does not disclose an aluminum bat having the unique features of the aluminum bat of this invention in which the long substantially straight and constant diameter barrel adds to the effective length of the hitting area or zone and an end cap of polymer material forms a closure for the end of the barrel to dampen vibration, enhance the impact characteristics, concentrate the weight load at the outer end of the bat and create the longer acceptable hitting area or zone.

SUMMARY OF THE INVENTION

An object of the present invention is to provide an aluminum ball bat utilizing a substantially straight, tubular barrel having an end cap of polymer material forming a closure for the end of the hollow barrel to dampen vibration of the aluminum bat when impacting a ball, provide enhanced impact characteristics to the bat, concentrate the weight load of the bat at the outer end and create a longer acceptable hitting area or zone.

Another object of the invention is to provide an aluminum baseball bat in which the hitting zone has a substantially constant external diameter in excess of 2⅝ inches and up to and including 2¾ inches with the hitting zone being substantially longitudinally straight and including continuous exterior and interior surfaces extending to the end of the bat remote from the handle with the end cap being anchored in relation to the end of the bat and providing a concentrated weight load at the end of the bat that is generally uniformly distributed concentrically about the longitudinal axis of the bat.

A further object of the invention is to provide an aluminum ball bat having an end cap in the outer end thereof in which the end cap is anchored to the bat and including various arrangements for forming a closure for the end of the bat, imparting strength characteristics to the bat, enhancing the impact characteristics of the bat with a ball, concentrating a weight load at the end of the bat and create a longer acceptable hitting area or zone.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
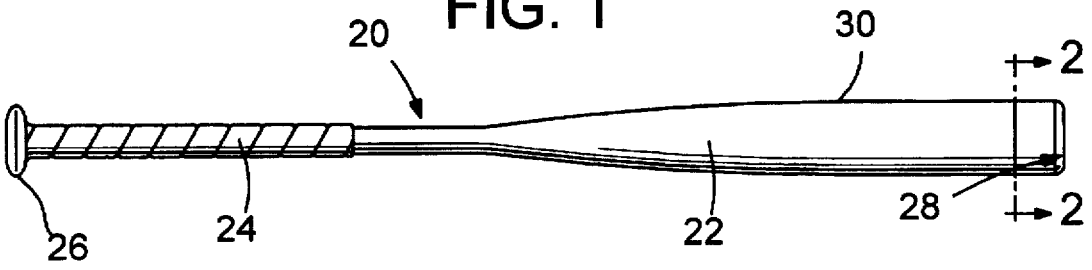
FIG. 1 is a side elevational view of an aluminum ball bat constructed in accordance with the present invention.
Figure 3:
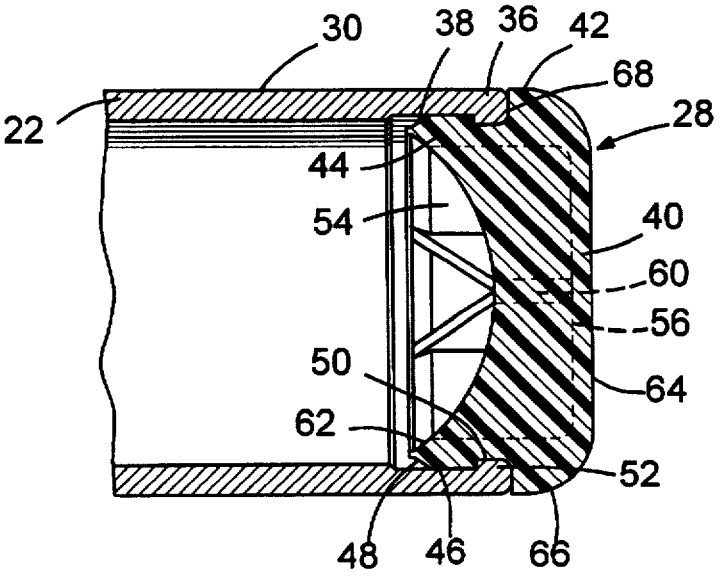
FIG. 3 is a longitudinal, sectional view taken along section line 3—3 on FIG. 2 illustrating the ridge and groove structure in the interior surface of the hollow end of the bat and the exterior surface of the end cap which is anchored to the bat.

FIG. 1 illustrates an aluminum bat 20 incorporating the features of the present invention therein and which includes a tubular barrel 22, a handle or hand grip 24, a knob 26 at one end of the bat and an end cap 28 at the other end. This general type of structure is known in presently available aluminum baseball bats. However, in present day aluminum baseball bats, when the diameter of the outer end portion of the barrel 22 exceeds 2⅝ inches, the tubular end of the barrel is crimped inwardly to receive a 2⅝ inch end cap by providing a stepped down or inwardly crimped area in the end of the barrel which results in substantial additional rigidity of the bat in order to withstand the impact when the bat is used to hit a baseball in the acceptable hitting zone 30. In this invention, the barrel 22 has a substantially constant diameter in excess of 2⅝ inches and up to and including 2¾ inches with the hitting zone 30 being substantially straight and the exterior and interior surfaces of the barrel being continuous to an outer end portion 36 which receives the end cap 28. As illustrated in FIG. 3, the end portion 36 of the barrel 22 is provided with a peripheral, shallow recess 38 spaced inwardly from the terminal end of the end portion 36 of the barrel 22.

The end cap 28 is constructed of a polymer material and includes a solid outer end portion 40 which has a short longitudinal periphery 42 that is substantially the same external diameter as the external diameter of the hitting zone 30. The end cap 28 also includes a generally cylindrical sleeve 44 which telescopes into the end portion 36 of the barrel 22. The sleeve 44 includes a cylindrical inner end portion 46 of a diameter to be closely received in the recess 38 in the end 36 of the barrel 22 with the inner end of the sleeve including an inwardly tapered surface 48 to facilitate insertion of the polymer end cap into the end of the barrel. Between the peripheral portion 42 of the end cap and the cylindrical portion 46, the end cap is provided with a peripheral groove or recess 50 which receives the internal terminal end portion 52 of the inner surface of the barrel 22 which, in effect, forms a ridge which is received in the recess 50 with the cylindrical surface 46, in effect, forming a ridge received in the peripheral groove or recess 38 thus serving to anchor the end cap to the end of the barrel 22.

The end cap 28 includes a cylindrical interior surface 54 which has an inner wall surface 56 paralleling the end wall of the end cap 28 as illustrated in FIG. 3 and includes a plurality of radial ribs 58 to reinforce the end cap with the radial ribs being joined at a center 60 of the end cap with the length of the ribs axially of the end cap and barrel being less at the juncture 60 than at the radial outer ends thereof. The outer ends of the ribs 58 extend throughout the length of the sleeve 44 and along an outwardly tapered inner edge 62 formed in the inner end of the sleeve 44 in generally opposite relation to the inwardly tapered surface 48. The axial outer end of the end cap 28 is generally flat and perpendicular to the longitudinal axis of the barrel and is designated by reference numeral 64. The peripheral corner of the end cap is arcuately curved at 66 and the juncture between the recess 50 and the external periphery of the end cap 28 defines a peripheral shoulder 66 which abuttingly engages the terminal end of the end portion 36 of the barrel. The groove 50 in the sleeve 44 of the end cap and the tapered portions 48, 62 enhance the flexibility of the sleeve to enable it to be forced into the end of the barrel with an interference fit.

With this construction, the hitting zone 30 of the barrel 22 is provided with an additional length and the diameter of the hitting zone remains substantially constant, over 2⅝ inches and not more than 2¾ inches, completely to the terminal end of the end portion 36 of the hitting zone which results in a barrel having the acceptable hitting zone lengthened by eliminating the stepped down or inwardly crimped terminal end portion which generally includes a slight inward taper on the barrel that effectively reduces the length of the hitting zone. The extended barrel length also provides a longer trampoline effect which enhances the function of the hitting zone. The construction of the end cap including the ribs provides additional strength to the hitting zone and barrel to more effectively withstand the impact forces generated when the bat hits a ball. The interference fit of the end cap with the end of the barrel causes the cylindrical portion 46 of the end cap to lock into the recess 38 in the barrel and the rib 52 on the barrel to lock into the recess 50 in the end cap thereby securely connecting the end cap to the barrel to dampen vibration normally imparted to the hands gripping the handle and enhancing the impact characteristics of the bat.

Figure 2:
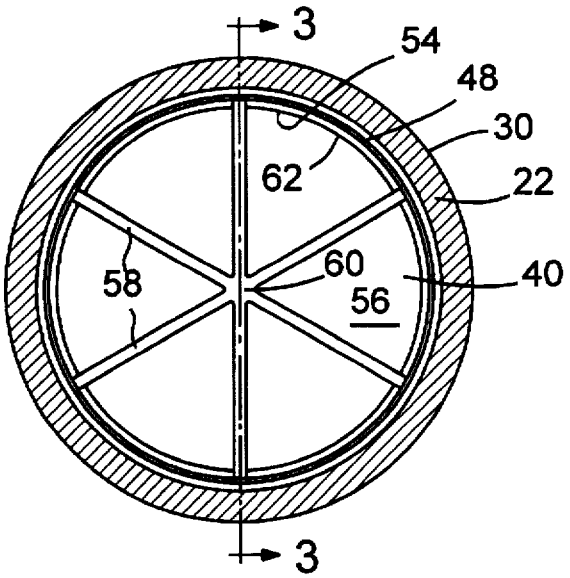
FIG. 2 is a transverse, sectional view taken along section line 2—2 on FIG. 1 illustrating the structure of the hitting zone of the bat and the interior structure of the end cap.
Figure 4:
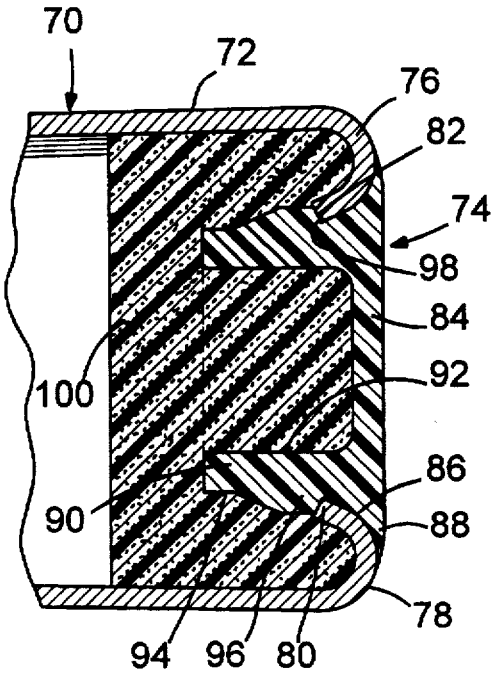
FIG. 4 is a longitudinal, sectional view of another embodiment of the end of the bat and end cap associated therewith.

FIG. 4 illustrates another embodiment of the present invention in which the barrel bat 70 has a substantially constant external diameter as in FIGS. 1–3 to establish a hitting zone 72. The end of the bat is provided with an end cap 74 anchored to the end of the barrel 70. In this construction, the bat barrel terminates in a reversely curved terminal end 76 which is smoothly curved inwardly as at 78 and then curves axially inwardly and radially inwardly as at 80 and terminating in an end edge 82 facing axially inwardly and radially inwardly of the bat barrel. The end cap 74 includes an end wall 84 that is substantially flat and forms a closure for the end of the bat barrel. The peripheral edge of the end wall 84 is arcuately curved at 86 to closely engage the corresponding curved surface of the inwardly curved portion 80 of the inturned end portion 78. The peripheral edge 88 of the end wall 86 is tapered to merge smoothly with the axial outer periphery of the inwardly curved end 78 of the bat barrel 70. The end wall 84 is provided with a peripheral sleeve 90 spaced inwardly of the peripheral edge 88 and extending axially inwardly beyond the terminal edge 82 of the inwardly extending portion 80 of the bat barrel. The sleeve 90 includes a cylindrical internal surface 92 and an external surface 94 that includes a peripheral ridge 96 terminating in an inclined abutment 98 connected with the curved surface 86 for abutting engagement with the inner edge 82 of the inturned end portion 78 of the bat barrel 20. The external diameter of the ridge 96 is greater than the internal diameter of the inner corner of the inner edge 82 of the inturned end portion of the bat barrel to provide an interference fit or force fit of the polymer end cap 74 with respect to the end of the bat barrel.

The end portion of the bat barrel 70 and the interior of the end cap is filled with a hardenable polymer material 100 to an axial extent greater than the axial extent of the sleeve 90 on the end cap thereby serving as a further anchor for the end cap in relation to the bat barrel. The polymer material 100 provides a concentrated weight load at the end of the barrel bat which can be varied by the volume of the end of the bat barrel that is filled with the hardenable material and the selected density and weight of the hardenable material which can be introduced from the handle end of the bat. This structure provides additional strength to the bat barrel and hitting zone 72, further dampens vibration and enhances the impact characteristics of the hitting zone 72 when impacting a ball.

Figure 5:
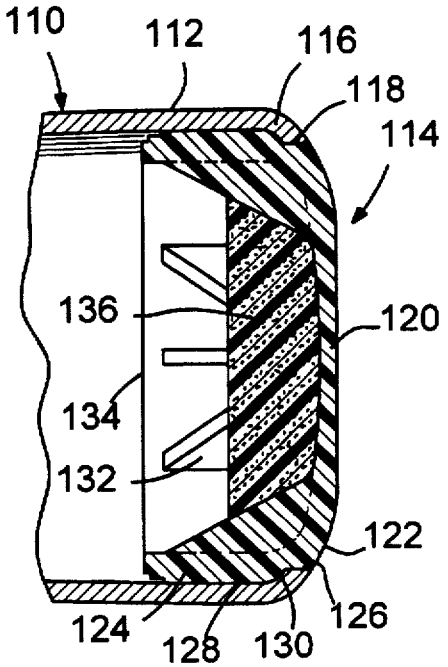
FIG. 5 is a longitudinal, sectional view of another embodiment of the end of the bat and end cap associated therewith.

FIG. 5 illustrates another embodiment of the bat of the present invention which includes the bat barrel 110 including a hitting zone 112 and an end cap 114. In this construction, the end portion of the hitting zone is curved inwardly at 116 for a relatively short distance which terminates in an end edge 118 that is substantially parallel to the longitudinal axis of the bat barrel 110 and only a short distance inwardly from the inner periphery of the bat barrel 110. The end cap 114 is provided with an end wall 120 having a rounded peripheral edge portion 122 forming a continuation of the external curvature of the inturned end 118 of the bat barrel. The end cap 114 includes a sleeve 124 which telescopes into the interior of the bat barrel with the external surface of the sleeve including a shoulder 126 which abuttingly engages the end edge 118 of the inturned portion 116 of the bat barrel. The sleeve 124 includes an external surface 128 which closely fits the internal surface of the bat barrel and the portion of the external surface 128 where it joins with the abutment 126 is curved at 130 to conform with the interior surface of the inturned end edge 116 of the bat barrel. The sleeve 124 is reinforced by a plurality of ribs 132 which extend radially from a position adjacent the inner end edge 134 of the sleeve to the interior surface of the end wall 120 inwardly of the shoulder 126 and outwardly of the center of the end wall 120. The interior of the sleeve 124 is provided with a hardenable polymer material 136 which extends axially a distance of approximately ½ of the internal length of the sleeve 124.

The internal surfaces of the bat and the external surfaces of the end cap are rigidly engaged with each other so that the end cap reinforces and strengthens the end of the hitting zone 112 with the hardenable material providing a concentrated weight load in the end cap with the extent and volume of the hardenable material 136 being varied to provide the desired concentrated weight load in the bat barrel 110.

Figure 6:
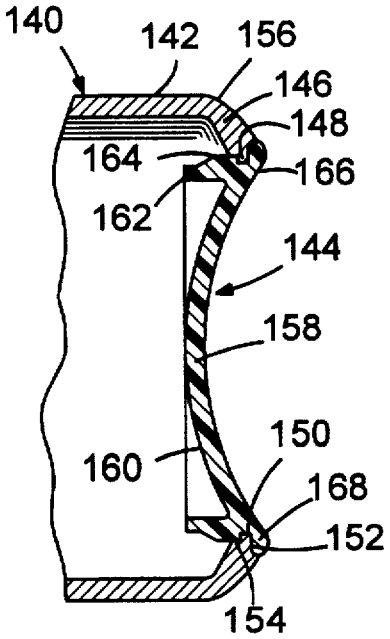
FIG. 6 is a longitudinal, sectional view of another embodiment of the end of the bat and end cap associated therewith.

FIG. 6 illustrates another embodiment of the bat barrel 140 including a hitting zone 142 and an end cap 144. In this construction, the end of the bat barrel is inclined radially inwardly and axially beyond the end of the hitting zone at 146 and terminates in a thickened internal edge 148 that includes a rib 150, an external recess 152 and an internal recess 154. The inturned end portion 146 is generally straight and its juncture with the end of the bat barrel is rounded at 156. The end cap 144 includes a concave end wall 158 having an outwardly facing concave surface and an inwardly facing convex surface 160. The end wall 158 includes a sleeve 162 of generally cylindrical configuration and having an enlarged or thickened area 164 where it joins with the end wall 158. The external surface of the juncture between the end wall 158 and the sleeve 162 includes a recess 166 which receives the rib or projection 150 with the thickened portion 164 of the sleeve 162 being engaged with the recess or surface 154 and the peripheral edge of the end wall 158 is provided with a lip 168 which is received in the recess 152 formed in the internal edge 148 of the inturned end 146 of the bat barrel 140. This structure provides a snap fit engagement with the bat barrel edge by the end cap edge with the inner surface of the convex portion of the end wall generally lying in the same plane as the inner edge of the generally cylindrical sleeve 162 as illustrated in FIG. 6. The end cap 144 is constructed of polymer material with the resiliency and flexibility thereof enabling the end cap to be snapped into engagement with the inturned end 146 of the bat barrel 140 to support and reinforce the end of the bat barrel 140.

Figure 7:
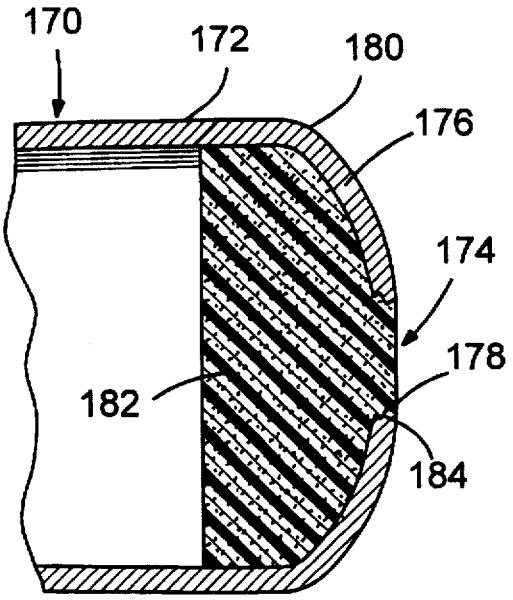
FIG. 7 is a longitudinal, sectional view of another embodiment of the end of the bat and the end cap associated therewith.

FIG. 7 illustrates another embodiment of the bat barrel 170 together with a ball hitting zone 172 and an end cap 174. In this construction, the end of the bat barrel is inwardly curved at 176 and terminates in a circular opening 178. The juncture between the inturned end portion 176 and the bat barrel 170 is smoothly rounded at 180. The end cap 174 is in the form of a hardenable material 182 which fills the end portion of the bat for a longitudinal distance to reinforce the bat barrel and provide a concentrated weight load. The surface of the end cap 182 received in the opening 178 terminates in coplanar relation to the end edge of the inturned end 176. The opening 178 is defined by a recess on its inner corner as designated by numeral 184 and an outwardly inclined edge defining the periphery of the opening 178 to interlock the hardenable material 182 with the opening 178 and positioning the hardenable material in the bat barrel 170. The volume and weight of the hardenable material 182 may be varied to provide the desired concentrated weight load in the end of the bat barrel 170.

Figure 8:
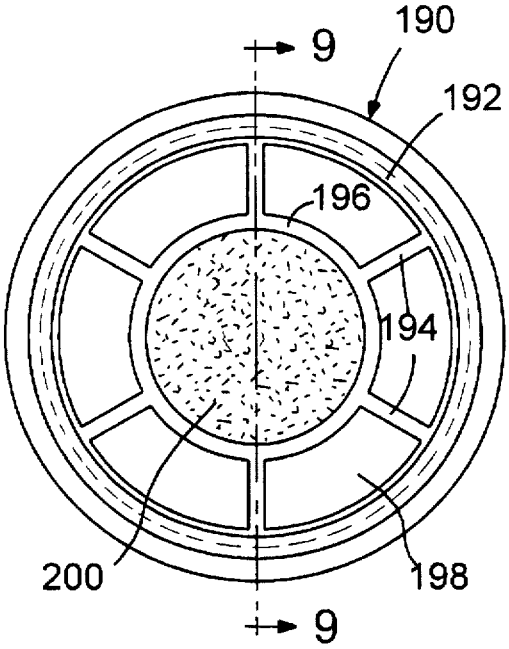
FIG. 8 is an inner end view of another end cap for utilization with the hollow end of the bat barrel illustrated in FIG. 3.
Figure 9:
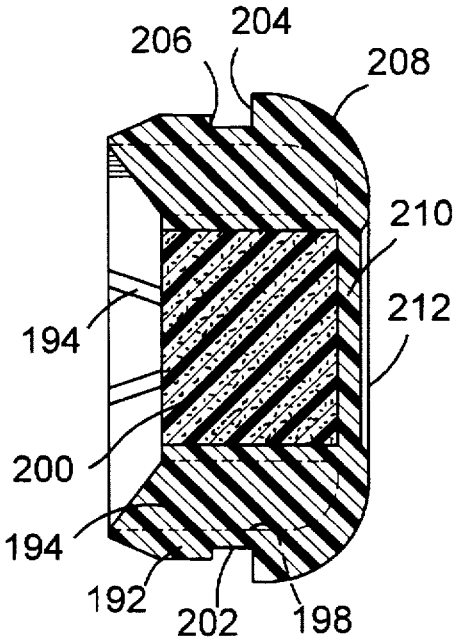
FIG. 9 is a vertical sectional view taken along section line 9—9 on FIG. 8 illustrating further structural details of the end cap.

FIGS. 8 and 9 illustrate another embodiment of the end cap generally designated by reference numeral 190 which can be used in lieu of the embodiment illustrated in FIGS. 1–3. In this construction, the sleeve 192 which telescopes into the bat barrel is provided with a plurality of radial ribs 194 which terminate at their inner ends in a cylindrical sleeve 196 concentric with the sleeve 192 with the space 198 defined by the sleeves 192 and 196 and the ribs 194 being empty or void to form a series of peripherally extending void spaces. The interior of the inner sleeve 196 is provided with a filler of hardenable material 200 which forms a concentrated weight load with the volume of the hardenable material being varied but not usually extending inwardly beyond the edge of the sleeve 196. The exterior of the sleeve 192 is provided with a groove 202 and shoulders 204 and 206 which receive the inwardly extending ridge on the bat barrel with the periphery of the sleeve inwardly of the shoulder 206 being received in the recess in the bat barrel. The end of the end cap that is flush with the external surface of the bat barrel is arcuately curved at 208 and the end wall 210 is flat or can be provided with a recess 212 for a logo or the like and can be configured either straight across the end of the cap or can be concave.

Figure 10:
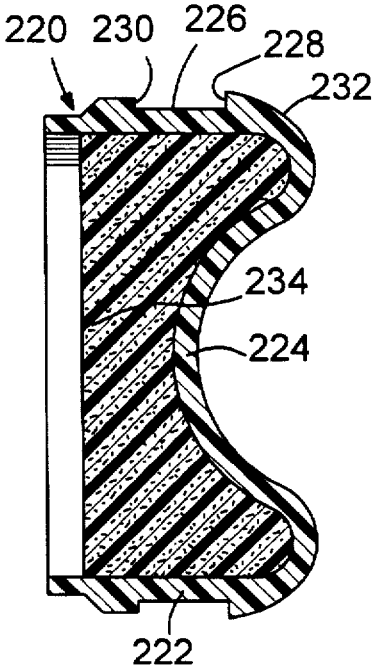
FIGS. 10, 11 and 12 are longitudinal sectional views illustrating end caps that can be associated with the hollow end of a tubular ball bat in a manner similar to that illustrated in FIG. 3.

FIG. 10 illustrates an end cap 220 which has a peripheral sleeve 222 and an end wall 224 that has a concave outer surface and a convex inner surface. The periphery of the sleeve 122 is provided with a recess 226 defining spaced shoulders 228 and 230 which receive a ridge on the interior surface of the bat barrel with the portion of the sleeve outwardly of the shoulder 228 being smoothly curved at 232 to merge with the end wall 224 and the portion of the sleeve inwardly of the shoulder 230 is received in the recess in the bat barrel. In this construction, the sleeve 222 does not include any reinforcing ribs but is filled with a hardenable material 234 to any level desired depending upon the concentrated weight load to be included in the end cap. As illustrated, the hardenable material may terminate inwardly of the end edge of the sleeve but may also extend all the way to the end edge or at any position between the end cap wall 224 and the inner edge of the sleeve.

Figure 11:
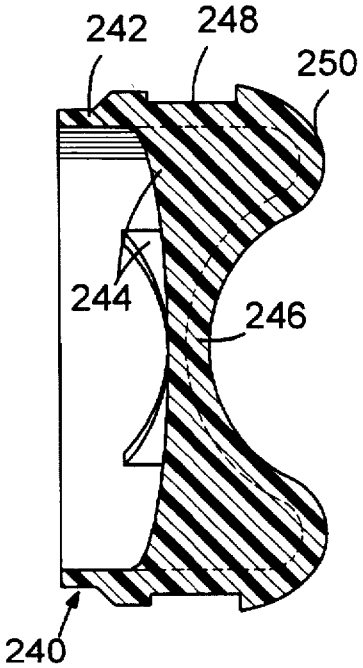

FIG. 11 illustrates another embodiment of the end cap 240 which is similar to that illustrated in FIG. 10 except that in this structure, the sleeve 242 is provided with reinforcing ribs 244 which extend radially inwardly from a position adjacent the longitudinal center of the sleeve to a position adjacent the end wall 246 with the end wall 246 being concave on the external surface and concave on the internal surface with the space between the ribs 244 being left vacant or provided with hardenable material if desired. The structure of the sleeve includes an external recess 248 and a curved corner surface 250 similar to that in FIG. 10.

Figure 12:
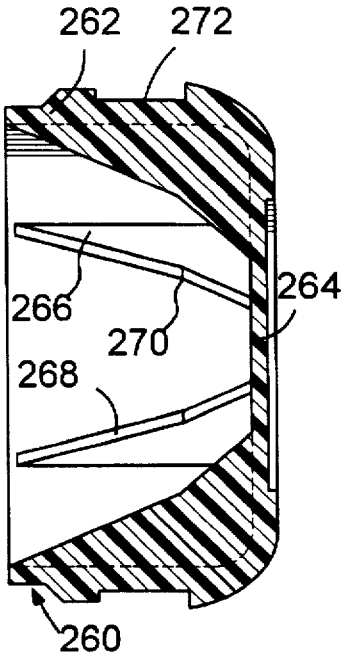

FIG. 12 illustrates another embodiment of the end cap designated by reference 260 and including a sleeve 262 and a flat or straight end wall 264 provided with reinforcing ribs 266 which extend from a point adjacent the inner edge of the sleeve 262 to an internal surface of the end wall 264 in spaced relation to the center thereof. The inner edges of the ribs 266 include angulated portions 268 joined at a juncture area 270 to effectively reinforce the sleeve and end wall. The periphery of the sleeve 262 is provided with a recess 272 similar to that illustrated in FIGS. 10 and 11 for receiving an internal ridge on the bat barrel with the portion of the sleeve inwardly of the recess 272 being received in a recess in the internal surface of the bat barrel.

The added weight provided by the hardenable material enables a concentrated weight load to be oriented at the end of the bat with the inertia generated by the weight load being maximized because the weight load is located as close as possible to the end of the bat barrel. The hardenable material is a polymer such as polyurethene and the polyurethene that constitutes the hardenable material may also assist in anchoring the end cap in place in the bat barrel. Also, a bonding agent or material may be provided between the end cap and the bat barrel such as an exopy resin or the like. Usually, the added weight material is approximately 1 inch in length and preferably not over 1½ inches in length with the concentrated weight load providing effective orientation of the weight at the end portion of the bat barrel. The added weight provided by the hardenable material is balanced about a central axis of the bat barrel in order to maintain proper balance of the bat during the arcuate movement of the bat as it is directed toward impact with a ball. The hardenable material may be placed in the bat after assembly of the end cap or in some instances may be associated with the end cap prior to assembly of the end cap with the bat barrel. The material from which the end cap is constructed is sufficiently flexible to enable the end cap to be inserted into the open end of the bat barrel and the structure of the ridges and grooves which are associated to retain the end cap in place provides for effective anchoring of the end cap to the bat barrel.

The provision of the conical or concave end wall in the end cap orients the weight center of the end cap closer to the handle portion of the bat and closer to the optimum area of the hitting zone to be impacted with a ball. This structure results in dampening of vibrations caused by impact with the ball which are usually transmitted to the hands gripping the handle portion of the bat. This arrangement also reduces the lever arm between the handle portion and the center of the weight load associated with the end cap to enhance the capability of the batter accelerating the hitting zone of the bat when the bat is passing through the area of the swing when the hands and wrists of the batter moves through a position in which the bat speed is accelerated as the wrists of the batter move from a "cocked" to a "uncocked" position thereby enhancing the impact force imparted to the ball to obtain maximum flight distance of the ball.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A metal ball bat comprising a tubular barrel having a handle at one end and a full length hitting zone of substantially constant diameter at an apposite end, said hitting zone having a substantially constant external diameter and being substantially longitudinally straight and including continuous exterior and interior surfaces extending to the end of the bat barrel remote from said handle, and an end cap in an end of said bat barrel remote from the handle and including a short peripheral portion having an external diameter substantially equal to that of the internal surface of the bat barrel, the interior surface of said barrel including a circular internal groove and a circular internal rib, said end cap including a circular internal groove and a circular external ridge receiving said rib on the bat barrel and extending into the bat barrel, wherein said end cap includes an end wall, said end wall being convex on its inner surface and concave on its outer surface to orient the center of the weight of the end cap inwardly of the end of the bat barrel toward the handle portion thereof and adjacent an optimum hitting area of the bat barrel.

2. The bat as defined in claim 1 wherein said end cap includes an end portion having a diameter substantially equal to the external diameter of the bat barrel and abuttingly engaging an end edge of the bat barrel to provide a continuation of the external surface of the bat barrel.

3. A metal ball bat comprising a tubular barrel having a handle at one end and a full length hitting zone of substantially constant diameter at an opposite end, said hitting zone having a substantially constant external diameter and being substantially longitudinally straight and including continuous exterior and interior surfaces extending to an end of the bat barrel remote from said handle, and an end cap in the end of said bat barrel remote from the handle and including a short peripheral portion having an external diameter substantially equal to that of the interior surface of the bat barrel, the interior surface of said barrel including a circular internal groove and a circular internal rib, said end cap including a circular internal groove and a circular external ridge receiving said rib on the bat barrel and extending into the bat barrel, wherein said end cap includes a sleeve telescoped into the bat barrel and having a plurality of reinforcing radial ribs extending from a portion of the end cap engaging the interior of the bat barrel to a portion of the end cap extending across the end of the bat barrel to rigidify said end cap and provide strength to the bat barrel.

4. A metal ball bat comprising a tubular barrel having a handle at one end and a full length hitting zone of substantially constant diameter at an oppoiste end, said hitting zone having a substantially constant external diameter and being substantially longitudinally straight and including continuous exterior and interior surfaces extending to an end of the bat barrel remote from said handle, and an end cap in the end of said bat barrel remote from the handle and including a short peripheral portion having an external diameter substantially equal to that of the interior surface of the bat barrel, the interior surface of said barrel including a circular internal groove and a circular internal rib, said end cap including a circular internal groove and a circular external ridge receiving said rib on the bat barrel and extending into the bat barrel, wherein said groove in the end cap is wider than the ridge, said rib and groove in the bat barrel corresponding in width to the groove and ridge on the end cap.

5. The bat as defined in claim 4 wherein said end cap includes an end wall, said end wall being convex on its inner surface and concave on its outer surface to orient the center of the weight of the end cap inwardly of the end of the bat barrel toward the handle portion thereof and adjacent an optimum hitting area of the bat barrel.

6. The bat as defined in claim 5 wherein said end cap includes a sleeve spaced concentrically from said short cylindrical portion, a plurality of reinforcing radial ribs extending between said end wall and said sleeve to rigidify said end cap and provide strength to the bat barrel.

* * * * *